US005106248A

United States Patent [19]

Harris

[11] Patent Number: 5,106,248

[45] Date of Patent: Apr. 21, 1992

[54] RETRACTABLE CLEAT DEVICE

[75] Inventor: Halford S. Harris, Live Oak, Fla.

[73] Assignee: Caysher, Inc., Live Oak, Fla.

[21] Appl. No.: 677,122

[22] Filed: Mar. 29, 1991

Related U.S. Application Data

[63] Continuation-in-part of Ser. No. 279,994, Dec. 5, 1988, Pat. No. 5,004,388.

[51] Int. Cl.[5] ..... B60B 21/04

[52] U.S. Cl. ..... 410/107; 410/111; 114/218

[58] Field of Search ..... 114/189, 199, 218; 410/82, 83, 107, 111

[56] References Cited

U.S. PATENT DOCUMENTS 4,820,093 4/1989 Hirakai et al. ..... 410/107
4,890,566 1/1990 Morris ..... 114/218
4,945,849 8/1990 Morris et al. ..... 114/218
5,004,388 4/1991 Harris ..... 410/107

*Primary Examiner*—Robert J. Oberleitner
*Assistant Examiner*—Alfred Muratori
*Attorney, Agent, or Firm*—Arthur G. Yeager

[57] ABSTRACT

The device has a hollow housing adaptable to be mounted in a marine deck and a spring-biased cleat is telescopically vertically movable therein. The cleat has a rotatably mounted cylinder cam which is engaged by one or more pins that function as cam followers and are releasably mounted to the housing. The cleat is selectively movable to its extended operating position by causing the rotation of the cam to position a different portion of the cam path or groove adjacent the follower via temporary downward force on the cleat and is thereafter automatically locked upon the next temporary force thereon to further rotate the cam.

20 Claims, 2 Drawing Sheets

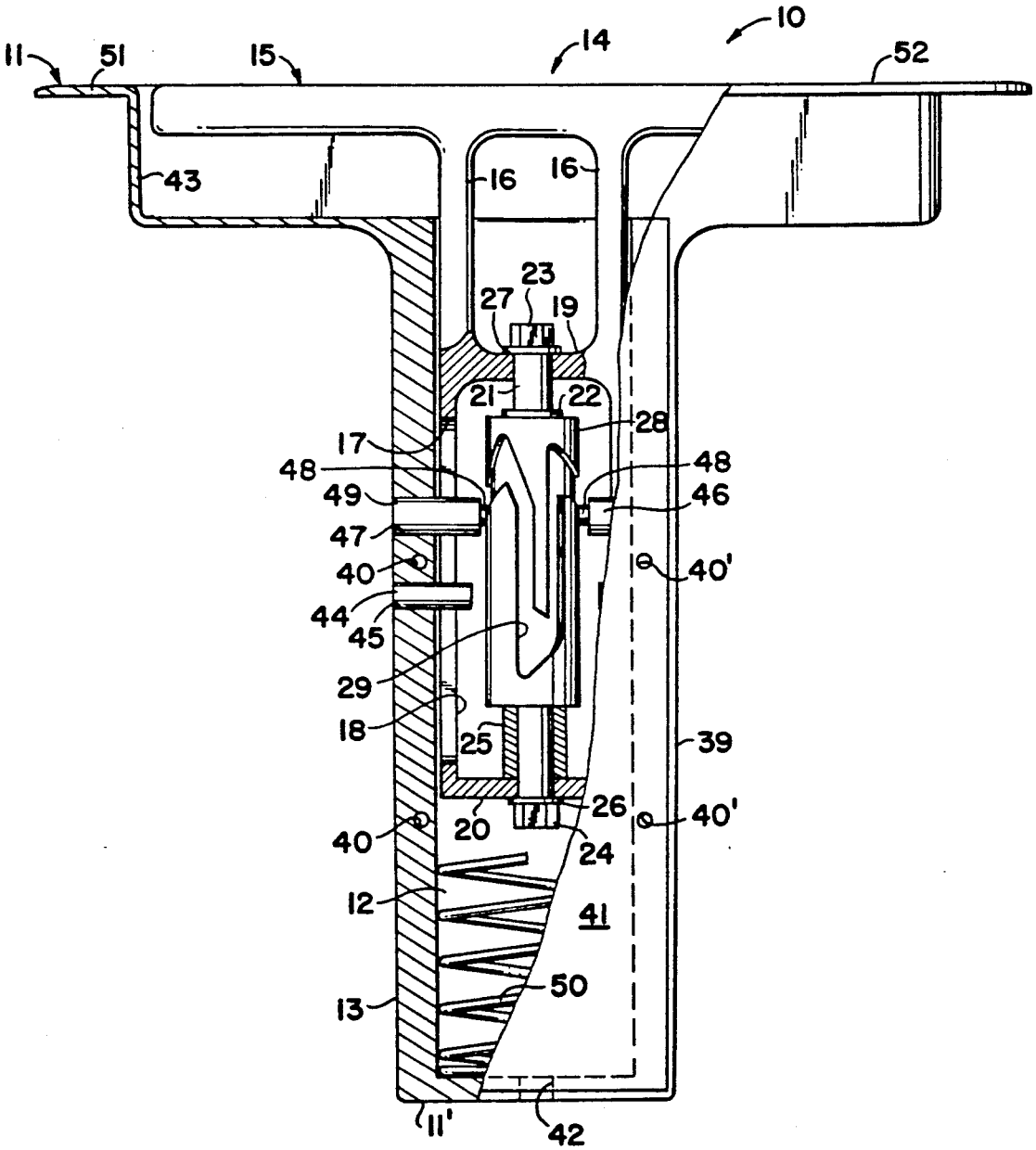
FIG 1
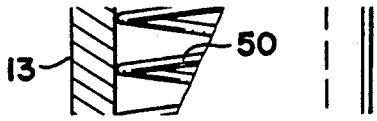

RETRACTABLE CLEAT DEVICE

RELATED APPLICATION

This application is a continuation-in-part of Ser. No. 07/279,994, entitled RETRACTABLE CLEAT DEVICE, filed on Dec. 5, 1988, now U.S. Pat. No. 5,004,388.

BACKGROUND OF THE INVENTION

1. Field of the Invention

The present invention relates to pop-up marine hardware devices for use in securing ropes, tow lines and the like and particularly to retractable cleat devices for use in marine vessel applications.

2. Prior Art

There are a wide variety of marine hardware devices used for securing two ropes and the like to vessels and similar vehicles. One objective of many designs is to provide a cleat that can be used in an upright position for use in securing ropes and cables while allowing the cleat to be moved downwardly out of sight and out of the way of people walking on the deck. In addition, the elevated or retracted nature of the cleat may be used to advantage in locking and releasing an attached cable as in U.S. Pat. Nos. 4,603,649, 4,458,631 and 4,423,697, and these often employ remotely operated hydraulic operating systems such as cylinders and jacks.

Devices that are designed to be retracted and therefore flush with a structural surface when not in use include U.S. Pat. Nos. 4,331,096, and 3,771,488, but these require tools such as wrenches to operate the mechanism. U.S. Pat. Nos. 4,672,909, and 4,354,445 disclose retractable cleats which must be lifted and turned 90° to be positioned in the upright condition. Other devices include the retractable cleat in U.S. Pat. Nos. 3,093,106, 4,820,093, 4,820,094 and 4,890,566. Retractable cleats which employ a rotational locking feature include U.S. Pat. Nos. 4,270,478, 3,126,859 and 1,402,496.

A number of retractable devices have been designed for use with trucks and cargo containers. See U.S. Pat. Nos. 4,321,000, 4,092,040, 3,892,436, 3,737,135 and 3,682,432. This latter group of devices work in conjunction with vehicle surfaces such as those found in trucks, trailers, and railcars.

Finally, many of the cleats of the prior art such as U.S. Pat. No. 4,890,566 are dependent upon gravity action for their operation and this could not be used in any position other than the vertical. What is desired is a retractable cleat device that has no such limitation.

SUMMARY OF THE INVENTION

In one aspect of the invention there is provided a retractable device for installation in a rigid structure such as the deck of a boat or the like which includes an elongated vertical hollow unitary housing adapted for mounting to a rigid structure, the housing having a top surface for mounting generally flush with a surface of a rigid structure. An elongated retractable member is slidably positioned in the housing and movable vertically therein and has an upper surface substantially flush with the top surface of the housing in a retracted position. A first mounting means between the housing and the member limits the vertical movement of the member. Selective operating means is included for moving the member from a first position wherein an upper end portion of the member is retracted in the housing to locate the upper surface flush with the top surface and a second position wherein the upper end portion is upraised above the top surface of the housing. The selective operating means is disposed within the housing and is lockable by a downward force on the upper portion to dispose the upper surface substantially below the top surface of the housing and subsequent release to assume the first position and being thereafter releasable by another downward force on the upper end portion to dispose the upper surface substantially below the top surface and subsequent release to assume the second position. The selective operating means includes cam means mounted on the member for being selectively engaged by the first mounting means at a first location in which the member is in the first position and a second location in which the member is in the second position.

Other aspects include a cam means which includes a cam element and second mounting means for rotatably mounting the cam element on the member, the cam element including a channel having spaced side walls formed therein. The first mounting means includes a pin laterally extending from the housing and positioned within the channel for selective engagement with the cam element. The pin is removably mounted to the housing to allow removal of the member while the housing is mounted in a rigid structure after removal of the pin. Alternatively, the first mounting means includes a pair of spaced pins removably mounted to the housing and disposed laterally within the housing, the cam element being rotatably mounted on the member and including a channel having spaced side walls formed therein with each said pin engaging a portion of the side wall for selective engagement of the cam element by each pin. When the member is depressed downwardly it causes moving contact between one side wall and the pin for first rotary movement of the cam element to position the member for subsequent locking in the first position, the member being released to the second position by being subsequently depressed downwardly to cause moving contact between the one side wall and the pin for second rotary movement of the cam element. The second mounting means includes a cam shaft to which the cam element is affixed and bearing means for rotatably mounting the cam shaft to the member.

In another aspect, the cam means includes a cylindrical cam element and second mounting means rotatably mounting the cam element on the member, the cam element having a continuous channel having spaced side walls formed therein which define a continuous cam follower path about the cam element, the first mounting means including a cam follower laterally extending from the housing and positioned within the path for selectively rotating the cam element by relative movement between the follower and the cam element for selective engagement of the cam element in the first and second positions. The first mounting means includes a second cam follower laterally extending from the housing and being diametrically opposed to the first cam follower, the second cam follower being positioned within the path for selectively rotating the cam element by contact between the first and second cam follower and the cam element for selective engagement of the cam element in the first and second positions. This aspect may also include a second cam follower laterally extending from the housing and being diametrically opposed to the first cam follower and positioned within the path for selectively rotating the cam element by relative movement between the first and second cam follower and the cam element for selective engagement of the cam element in the first and second positions as before. The member may also include a pair of side walls with at least one side wall having a vertically disposed laterally aligned slot and the first mounting means including a rod affixed to the housing and extending through the one slot for limiting the vertical movement of the member to the length of the slot.

In the above aspects of the invention the cam follower is mounted to the housing in a position to contact and cause rotation of the cam element in a predetermined direction when the member is forced downwardly for positioning the cam element to provide a first and second respective locking engagement with the cam follower and maintain the member in its first and second respective positions when downward force on the member is removed and subsequent movement of the member by the compression means.

An additional aspect is seen in which the housing includes a plurality of interior surfaces, the interior surfaces being located spacedly away from the retractable member to allow movement of the member within the housing and installation and removal of the member through the top surface of the housing while the housing remains mounted in the rigid structure.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 1 is a front partial cross-sectional view of the retractable cleat device in accord with the present invention;

DETAILED DESCRIPTION OF THE PREFERRED EMBODIMENT

Figure 2:
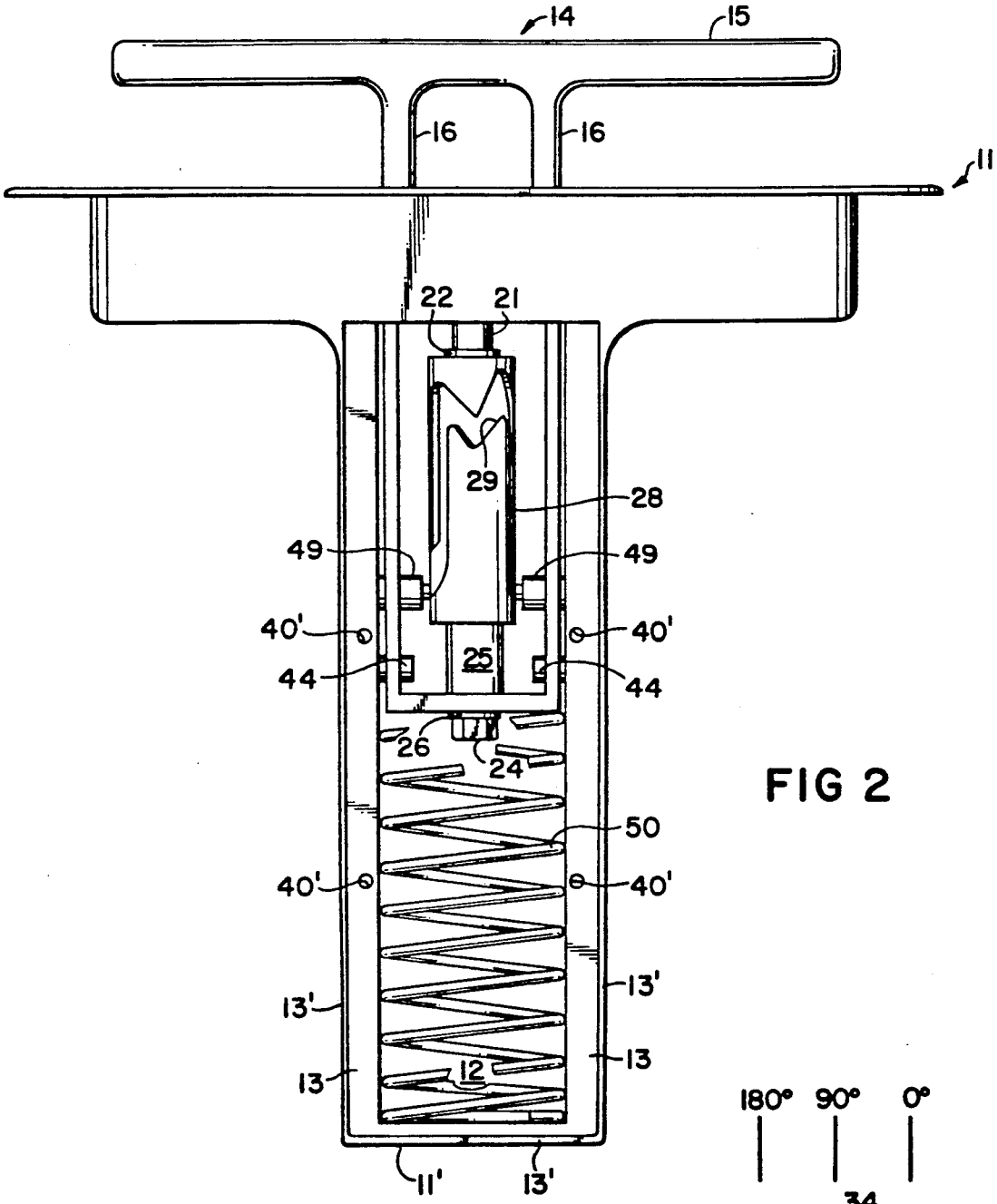
FIG. 2 is a front elevation of the retractable cleat of FIG. 1 with the front panel removed to illustrate the cleat in the upraised extended position.

With respect now to FIG. 1, the retractable cleat device in accord with the present invention is depicted at numeral 10. The device 10 includes a unitary housing 11 defining an interior space by way of side walls 13, rear wall 12 and a bottom 11'. A cleat 14 with an upper handle portion 15 with two spaced apart arm members 16 with side members 17 having vertical slots 18 below a cross-member 19 and a bottom 20.

Mounted within the side members 17 of the cleat 14 is a cam shaft 21 mounted between cross-member 19 and bottom 20 via upper and lower socket head screw 23, 24 respectively, and retaining rings 22, 26, 27 as understood in the art. Spacer 25 provides for proper positioning of the cam 28 mounted on shaft 21. Cam 28 is comprised of a cylinder cam element having a follower channel path or groove 29 that will be discussed in greater detail hereinbelow.

The front surface edges 39 of side wall 13 have drilled screw holes 40 for the securing of a removable front panel 41 via screws 40'. The housing 11 has a drain hole 42 in lower portion 11' for the removal of water and debris. Upper interior space 43 provides sufficient space for the vertical movement of handle 15 of cleat 14 when being operated.

The upper travel limit of cleat 14 is provided by limit pins 44 that are releasably secured into walls 13 via a hole 45 and which positions the pin into the respective slot 17 of sides 18 of cleat 14. Preferably, the pins 44 are installed as a press fit and thus can easily be punched or pulled out to allow for vertical withdrawal of the cleat 14 upwardly from housing 11 without the need to remove the housing 11 from the deck or structure into which it is installed. Housing 11 itself is installed into a structure via screw holes 51 in housing flange 52.

Cylinder cam 28 is rotated by way of one or two cam followers 49 which are comprised of a rod having a body 46 and a pin portion 48 that fits within channel 29. Followers 49 are press fit into holes 47 to allow for ease of removal and assembly of cleat 14 into housing 11. The cleat 14 is biased upwardly by compression spring 50. Rods 44 and 49 can also be secured into the respective holes 45, 47 via laterally disposed removable screws as understood in the art.

Figure 3:
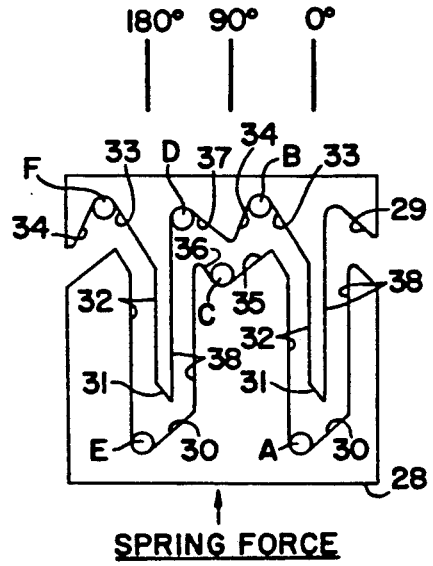
FIG. 3 is a flat pattern illustration of the cylinder cam used in the present invention.

With respect now to FIG. 3, a flat pattern drawing of the cylinder cam 28 is illustrated for use in describing the operation of the device 10. With a cam follower 49 shown in position "A" resting against a channel surface 29, the cleat 14 will be in the upright or extended position. If the cleat 14 is depressed downwardly, stationary follower 49 will cause cam cylinder 28 to rotate by first contacting channel wall or surface 31. The cam 28 can then move downwardly with follower 49 riding vertically in channel portion 32 and into contact with wall 33. Follower 49 will come to rest in position "B" with cam 28 rotated approximately 45° from its original position. Position "B" represents the downward limit of travel for cleat 14. When cleat 14 is now released, spring force from compression spring 50 will push cleat 14 upwardly putting surface or wall 35 into contact with follower 49 causing additional rotation of the cleat by 45° placing follower 49 in position "C". The cleat 14 is now locked in the downward or retracted position.

From the retracted position with the follower in position "C", downward force on cleat 14 will place channel wall 37 in contact with follower 49 causing rotation of cam 28 with further downward movement of cleat 14 limited by the follower 28 being in position "D". If the cleat 14 is now released, the cam 28 is free to move vertically upward through channel portion 38 until the follower 49 contacts surface 30 causing further rotation until the follower 49 is in position "E". Subsequent movement of the cleat will move cam 28 to put follower 49 in position "F" as the cycle repeats.

Preferably, two cam followers 49 are used to improve the force-loading capability of two pins instead of one. With respect to FIG. 3, a two-follower device 10 will have the followers 49 in positions "A" and "E" in the upright position of the cleat 14. Also, it is preferable that there are two travel limit pins 44 positioned to engage the bottom of slots 17 at the point where the followers 49 are in the positions "A" and "E". This design also provides additional load handling capability for the cleat 14 in the extended position where a rope will be connected to the arm members 16 and handle 15.

The present invention contemplates the use of the cleat device 10 in a vertical position in the deck of a boat or similar rigid structure. It is to be understood, however, that the cleat device 10 is usable in a horizontal position due to the bias of spring 50 and the engagement of one or more cam follower pins 48 with the cam follower path or channel 29 in the cylindrical cam element 28.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A retractable device for installation in a vehicle comprising an elongated vertical hollow unitary housing adaptable for mounting to a rigid structure of the vehicle, said housing having a top surface adapted to be mounted flush with a surface of said rigid structure, an elongated retractable member slidably positioned in said housing and movable vertically therein, said member having an upper surface substantially flush with said top surface of said housing in a retracted position; first mounting means between said housing and said member for limiting the vertical movement of said member, selective operating means for moving said member from a first position wherein an upper end portion of said member is retracted in said housing to position said upper surface flush with said top surface and a second position wherein said member upper end portion is upraised above said top surface of said housing, said selective operating means disposed within said housing and being lockable by a downward force on said upper portion to dispose said upper surface substantially below said top surface of said housing and subsequent release to assume said first position and being thereafter releasable by another downward force on said upper end portion to dispose said upper surface substantially below said top surface and subsequent release to assume said second position, said selective operating means including cam means mounted on said member for being selectively engaged by said first mounting means at a first location in which said member is in said first position and a second location in which said member is in said second position.

2. In the device as defined in claim 1 wherein said cam means includes a cam element, second mounting means for rotatably mounting said cam element on said member, said cam element including a channel having spaced side walls formed therein, said first mounting means including a pin laterally extending from said housing and positioned within said channel for selective engagement with said cam element.

3. In the device as defined in claim 2 wherein said pin is removably mounted to said housing to allow removal of said member while said housing is mounted in said rigid structure after removal of said pin.

4. In the device as defined in claim 2 wherein said member when depressed downwardly causes moving contact between one of said side walls and said pin for first rotary movement of said cam element to position said member for subsequent locking in said first position, said member being released to said second position by being subsequently depressed downwardly to cause moving contact between said one side wall and said pin for second rotary movement of said cam element.

5. In the device as defined in claim 2 wherein said second mounting means includes a cam shaft to which said cam element is affixed and bearing means for rotatably mounting said cam shaft to said member.

6. In the device as defined in claim 1 wherein said first mounting means includes a pair of spaced pins removably mounted to said housing and disposed laterally within said housing, said cam element being rotatably mounted on said member and including a channel having spaced side walls formed therein, each said pin engaging a portion of a said side wall for selective engagement of said cam element by each said pin.

7. In the device as defined in claim 1 wherein said cam means includes a cylindrical cam element, second mounting means rotatably mounting said cam element on said member, said cam element having a continuous channel having spaced side walls formed therein, said channel defining a continuous cam follower path about said cam element, said first mounting means including a cam follower laterally extending from said housing and positioned within said path for selectively rotating said cam element by relative movement between said follower and said cam element for selective engagement of said cam element in said first and second positions.

8. In the device as defined in claim 7 wherein said first mounting means includes a second cam follower laterally extending from said housing and being diametrically opposed to first said cam follower, said second cam follower positioned within said path for selectively rotating said cam element by contact between said first and second cam follower and said cam element for selective engagement of said cam element in said first and second positions.

9. In the device as defined in claim 7 wherein said first mounting means includes a second cam follower laterally extending from said housing and being diametrically opposed to first said cam follower, said second cam follower positioned within said path for selectively rotating said cam element by relative movement between said first and second cam follower and said cam element for selective engagement of said cam element in said first and second positions, said cam follower engaging said cam element for maintaining said member in a first retracted position, said selective operating means including compression spring means for biasing said member upwardly, said cam followers being mounted to said housing in a position to contact and cause rotation of said cam element in a predetermined direction when said member is forced downwardly upon application of a first downward force for positioning said cam element to provide a first locking engagement with said cam follower and maintain said member in its retracted said first position when said first downward force on said member is removed and subsequent movement of said member by said compression means, said cam followers causing rotation of said cam element in said predetermined direction upon application of a second subsequent downward force, said cam element being rotated by said cam follower when said second downward force is removed, said spring means moving said member upwardly such that said cam follower rotates said cam element in a direction to provide a second locking engagement with said cam follower, said member being operated in its upraised said second position by said spring means.

10. The retractable device as defined in claim 1 wherein said member includes a pair of side walls with at least one of said side walls having a vertically disposed laterally aligned slot, said first mounting means including a rod affixed to said housing and extending through said one slot for limiting the vertical movement of said member to a length of said slot.

11. The retractable device as defined in claim 1 wherein said selective operating means includes a cam element, means mounting said cam element to said member to be freely rotatable about an axis, said housing having a cam follower extending laterally therein, said cam follower engaging said cam element for maintaining said member in said first position, and compression spring means for biasing said member upwardly.

12. The retractable device as defined in claim 11 wherein said cam follower is mounted to said housing in a position to contact and cause rotation of said cam element in a predetermined direction when said member is forced downwardly for positioning said cam element to provide a first locking engagement with said cam follower and maintain said member in its said second position when downward force on said member is removed and subsequent movement of said member by said compression means.

13. The retractable device as defined in claim 12 wherein said cam follower causes rotation of said cam element in said predetermined direction upon application of a downward force, said cam element being rotated by said cam follower when such downward force is removed, said spring means moving said member upwardly such that said cam follower rotates said cam element in a direction to provide a second locking engagement with said cam follower said member being operated to its said first position by said spring means.

14. The retractable device as defined in claim 1 wherein said housing includes a plurality of interior surfaces, said interior surfaces being located spacedly away from said retractable member to allow movement of said member within said housing and installation and removal of said member through said top surface of said housing while said housing is mounted in said rigid structure.

15. The retractable device as defined in claim 1 wherein said member includes a pair of side walls with at least one of said side walls including a vertically disposed laterally aligned channel having opposite end portions, said first mounting means including a rod affixed to said housing and extending into said channel for limiting the vertical movement of said member to a length of said channel.

16. A retractable device for installation in a vehicle comprising an elongated hollow unitary housing adaptable for mounting to a rigid structure of the vehicle, said housing having an outer surface adapted to be mounted substantially flush with a surface of said rigid structure an elongated retractable member slidably positioned in said housing and movable vertically therein, said member having an outer surface substantially flush with said outer surface of said housing in a retracted position; first mounting means between said housing and said member for limiting the movement of said member, selective operating means for moving said member from a first position wherein an end portion of said member is retracted in said housing to position said outer surface of said member flush with said outer surface of said housing and a second position wherein said member end portion is upraised above said outer surface of said housing, said selective operating means disposed within said housing and being lockable by an inward force on said end portion of said member to dispose said outer surface of said member substantially below said outer surface of said housing and subsequent release to assume said first position and being thereafter releasable by another inward force on said end portion of said member to dispose said outer surface of said member substantially below said outer surface of said housing and subsequent release to assume said second position, said selective operating means including cam means mounted on said member for being selectively engaged by said first mounting means at a first location in which said member is in said first position and a second location in which said member is in said second position.

17. In the device as defined in claim 16 wherein said cam means includes a cam element, second mounting means for rotatably mounting said cam element on said member, said cam element including a channel having spaced side walls formed therein, said first mounting means including a pin laterally extending from said housing and positioned within said channel for selective engagement with said cam element, said member when depressed inwardly causes moving contact between one of said side walls and said pin for first rotary movement of said cam element to position said member for subsequent locking in said first position, said member being released to said second position by being subsequently depressed inwardly to cause moving contact between said one side wall and said pin for second rotary movement of said cam element.

18. In the device as defined in claim 16 wherein said cam means includes a cylindrical cam element, second mounting means rotatably mounting said cam element on said member, said cam element having a continuous channel having spaced side walls formed therein, said channel defining a continuous cam follower path about said cam element, said first mounting means including a cam follower laterally extending from said housing and positioned within said path for selectively rotating said cam element by relative movement between said follower and said cam element for selective engagement of said cam element in said first and second positions said first mounting means including a second cam follower laterally extending from said housing and being diametrically opposed to first said cam follower, said second cam follower positioned within said path for selectively rotating said cam element by contact between said first and second follower and said cam element for selective engagement of said cam element in said first and second positions.

19. The retractable device as defined in claim 16 wherein said selective operating means includes a cam element, means mounting said cam element to said member to be freely rotatable about an axis, said housing having a cam follower extending laterally and perpendicularly to said axis, said cam follower engaging said cam element for maintaining said member in said first position, and compression spring means for biasing said member outwardly.

20. The retractable device as defined in claim 19 wherein said cam follower is mounted to said housing in a position to contact and cause rotation of said cam element in a predetermined direction when said member is forced inwardly for positioning said cam element to provide a first locking engagement with said cam follower and maintain said member in said second position when inward force on said member is removed and subsequent movement of said member by said compression means, said cam follower causing rotation of said cam element in said predetermined direction upon application of an inward force, said cam element being rotated by said cam follower when said inward force is removed, said spring means moving said member outwardly such that said cam follower rotates said cam element in a direction to provide a second locking engagement with said cam follower, said member being operated to its said second position by said spring means.

* * * * *